US006087601A

United States Patent [19]

Callender et al.

[11] Patent Number: 6,087,601

[45] Date of Patent: Jul. 11, 2000

[54] MODULAR MULTI-PURPOSE SWITCH

[75] Inventors: Caroline Callender, Pontiac; Karen E. Grossi, Rochester, both of Mich.

[73] Assignee: Valeo Electrical Systems, Inc., Auburn Hills, Mich.

[21] Appl. No.: 09/366,461

[22] Filed: Aug. 3, 1999

[51] Int. Cl.[7] ..... H01H 9/26

[52] U.S. Cl. ..... 200/5 A; 200/5 R

[58] Field of Search ..... 200/5 R, 5 A, 200/314–316, 61.85, 11 TW, 14, 329, 294–296, 293, 520, 553, 562, 563, 311–313

[56] References Cited

U.S. PATENT DOCUMENTS

| | | | |
|---|---|---|---|
| 3,793,491 | 2/1974 | Cryer . | |
| 4,072,840 | 2/1978 | Daicle . | |
| 5,281,779 | 1/1994 | Bogovican et al. . | |
| 5,770,825 | 6/1998 | Yamaguchi et al. | 200/5 R |
| 5,949,149 | 9/1999 | Shitanaka et al. | 307/10.1 |

*Primary Examiner*—Michael L. Gellner
*Assistant Examiner*—Nhung Nguyen
*Attorney, Agent, or Firm*—J. Gordon Lewis

[57] ABSTRACT

Switch apparatus in the form of a family of like bases and interconnected housings each carrying two switch actuators and switch circuits. Conductive traces on each printed circuit board are engaged by contact elements operable by movement of each switch actuator to provide signals to connector terminals extending through the base for engagement with an external connector. The base is keyed to the external connector to accept only a specific connector in a specific base to connector orientation. The base includes key members permitting the base to be mounted in only one specific mounting position and one specific orientation in a support. 180° rotation of the base permits the base to be mounted in a different mounting position with different key members. A high current contact is carried on the base and actuated by a switch actuator to operate a high current device.

15 Claims, 9 Drawing Sheets

MODULAR MULTI-PURPOSE SWITCH

BACKGROUND OF THE INVENTION

1. Field of the Invention

The present invention relates, in general, to electric switches and, more specifically, to electrical switches mounted in vehicles, such as on the instrument panels of vehicles.

2. Description of the Relevant Art

Automotive vehicles use numerous switches to control various operating devices, such as heated seats, fog lamps, traction control, deck lid release, instrument panel light dimmer to name a few. Such switches are of a variety of different types including momentary hold down, push, rotary with defined detents, and rotary with potentiometer-type Action. In addition, most automotive switches include internal indicators, such as lamps or LEDs mounted within the switch housing, which illuminate transparent inserts mounted on the outer face of the switch to identify the location of the switch when the vehicle is operating and/or to indicate that the particular operating device controlled by the switch is operative.

Typically, automotive switches are formed of a large number of individual components and cut leads or wire connections for switch operation, including activation of a lamp or LED, as well as providing switch output(s) via plug-in connectors to operate the controlled device or circuit controlled by the switch.

In addition, during the design of an automotive vehicle, the layout and function of switches on the instrument panel frequently changes, oftentimes late in the development of the vehicle. This frequently results in extensive changes to the switch design and its mounting location in the instrument panel since such switches have previously been designed as an individual switch assembly typically including a pushbutton, a housing carrying the operative circuits actuated by movement of the pushbutton or thumb wheel actuator, and a base or lower support which is coupled to the housing and provides mounting connections to the instrument panel as well as connections to a plug-in electrical connector attached to a vehicle wiring harness. A change in the switch function or its mounting position in the instrument panel frequently results in changes to some or all of the individual switch components.

Further, the large number of individual components forming a typical instrument panel switch assembly as well as the large number of individual cut leads or wires in such switches results in an overly large switch, a lengthy switch assembly time, as well as difficult and time consuming installation of the switch in the instrument panel.

Thus, it would be desirable to provide a switch particularly for use in a vehicle which is economical in terms of a reduced number of individual components and cut lead or wire connections, has a compact, lightweight space saving size, is easy to install in a vehicle instrument panel or other mounting location in a vehicle and includes common elements which facilitate design flexibility with respect to switch function and mounting position in the vehicle.

SUMMARY OF THE INVENTION

The present invention is a switch apparatus having a modular, multi-purpose design. The inventive switch apparatus is particularly suited for use in an automotive vehicle, such as a switch apparatus mounted along with a number of similar switch apparatus in a vehicle instrument panel, or other vehicle mounting location.

In one aspect of the present invention, a switch apparatus is mountable in a vehicle support, such as vehicle instrument panel or housing mountable in an instrument panel. The switch apparatus includes a housing, and two independently operable switch actuators mounted in the housing, each having at least defined first and second positions. A base is coupled to the housing. Preferably, in this aspect of the invention, a single base and a single housing are used for a number of like switch apparatus.

At least one and, preferably, two printed circuit boards are mounted in the base and have connector terminals extending externally through the base. Each printed circuit board carries a switch control circuit electrically connected to the connector terminals and actuated by one of the switch actuators. Means are carried on the printed circuit board and interact with the switch actuator for providing signals to the connector terminals in response to movement of each switch actuator between the first and second positions.

Each switch actuator is carried in the housing, either in a fixed position or in a slidable arrangement. In the latter arrangement, at least one projection is formed on one of the housing and switch actuator and slides within an elongated aperture formed in the other of the switch actuator and housing to slidably control the movement of the switch while maintaining the switch actuator on the housing.

In one aspect of the invention, a switch is carried on one printed circuit board and has a movable plunger closing a contact to generate an output signal when the plunger is engaged by movement of the actuator between the first and second positions.

Keying means are provided for keying the base to the vehicle support in only one mounting position. In one aspect of the invention, the keying means is unique to each base and includes a pair of uniquely shaped or oriented key members extending from the base and insertable into complementary shaped slots in the vehicle support.

According to another aspect of the present invention, the same base is rotated 180° from the first base mounting orientation and provided with different oriented and positioned keying means for use of the same base and housing to support multiple switch apparatus.

In one aspect of the invention, one switch actuator is a rotary wheel having at least one leaf contact projecting therefrom and engagable with conductive traces on the printed circuit board.

According to another aspect of the present invention, at least one illuminatable element, such as a transparent or translucent sheet is carried on each switch actuator. An illuminatable member, such as a lamp or LED, is carried on the printed circuit board and disposed in light communication with the illuminatable element via light channels formed interiorly within the housing and the switch actuator.

The switch of the present invention affords numerous advantages over previously devised switches used in automotive vehicle applications. The inventive switch has a reduced number of individual parts and cut leads or wiring connections. This results in a smaller, compact, lightweight size compared to previously designed vehicle switch apparatus. This compact, small size also simplifies installation of the switch in a vehicle instrument panel or other vehicle mounting location as well as contributing to an economical manufacturing cost.

Further, the inventive switch utilizes common elements which can be used in a family of like switches in a particular vehicle. Key means are provided in the switch assembly to ensure accurate placement of each switch apparatus in the instrument panel or other mounting location as well as to ensure that the proper body wiring cable or harness connector is attachable to the correct switch apparatus.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1B:
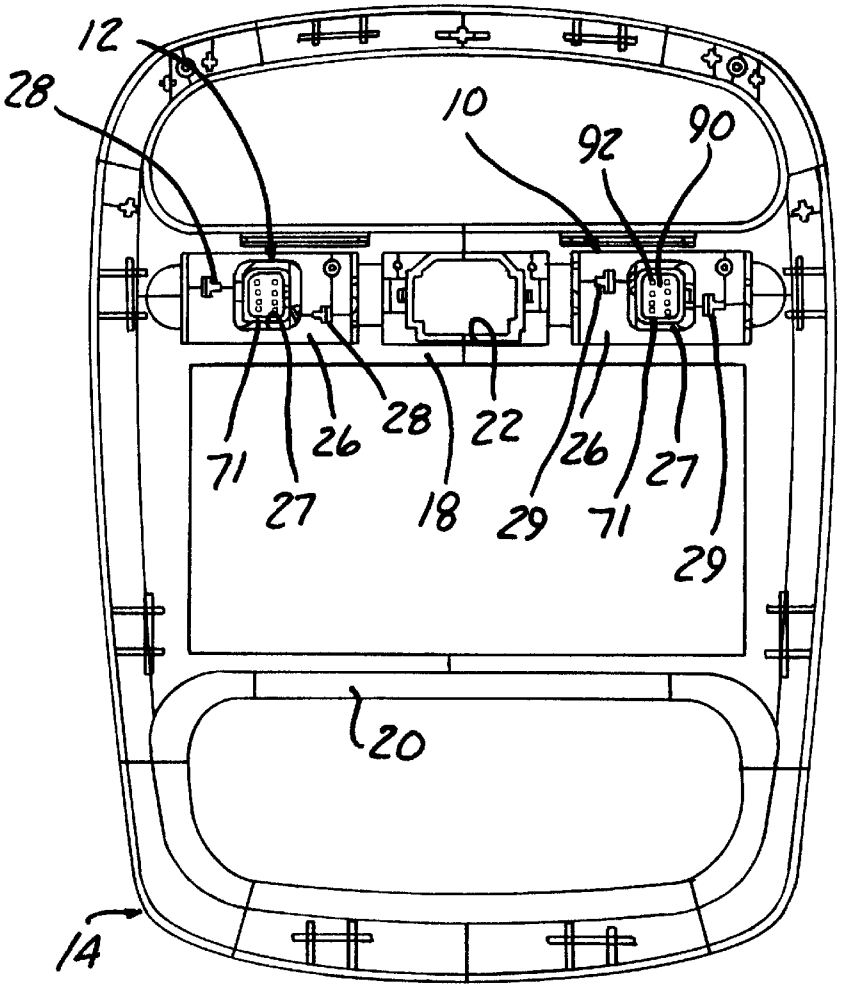
FIG. 1B is a rear elevational view of the switch apparatus and vehicle instrument panel housing shown in FIG. 1.

Referring now to the drawing, and to FIGS. 1A–9 in particular, there is depicted switch apparatus 10 and 12 which are part of a family of switches constructed in accordance with the teachings of the present invention.

The switch apparatus 10 and 12 are mountable in a vehicle instrument panel housing 14. It will be understood that the switch apparatus 10 and 12 may also be mounted in other locations within the vehicle, including the door, floor console, etc.

Figure 1A:
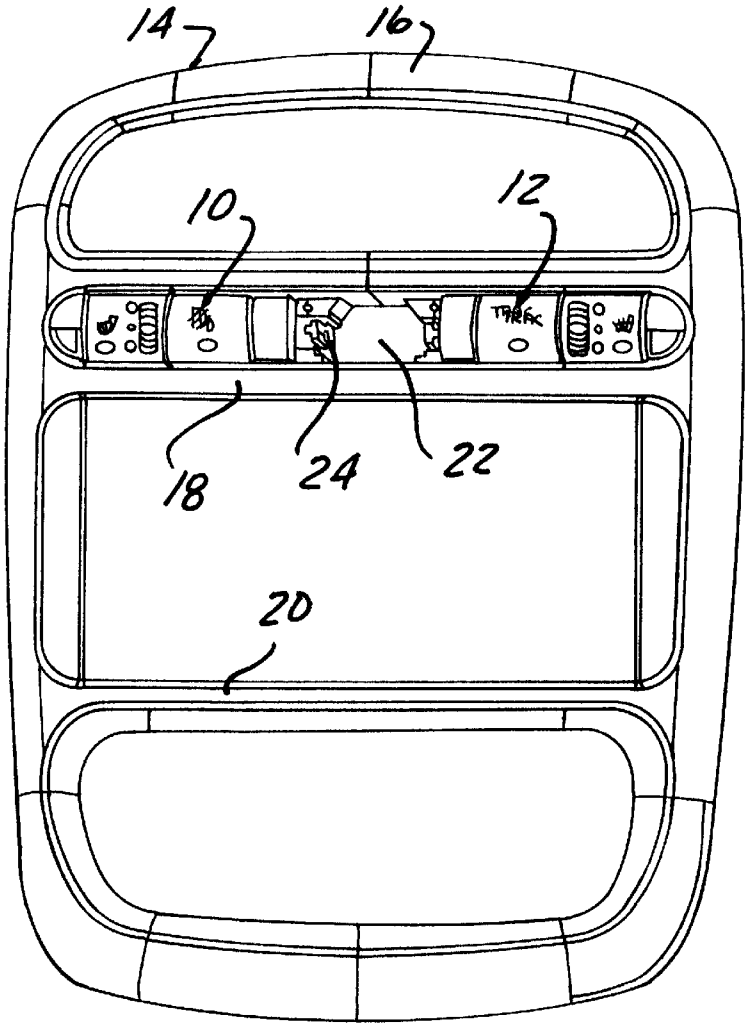
FIG. 1A is a front view of a switch apparatus according to one aspect of the present invention mountable in a vehicle instrument panel housing.

As shown in FIGS. 1A and 1B, by example only, the instrument panel housing 14 is formed as a one-piece, molded plastic member. The housing 14 which has the illustrated shape by example only, may form part of the vehicle instrument panel or be mounted in the vehicle instrument panel depending on the particular vehicle model.

Thus, by example, the housing 14 includes an outer peripheral wall 16 and a pair of intermediate cross-strips 18 and 20 which divide the housing 14 into three spaced openings capable of receiving HVAC vents, radio and heater controls, etc.

The upper intermediate strip 18 is formed with at least two and preferably three recesses, the outer two of which receive the switch apparatus 10 and 12. Two opposed interior side walls forming each recess and similar to the center recess 22 include apertures 24 which receive latch arms mounted on opposed side walls of each switch apparatus 10 and 12, as described hereafter, to releasibly mount each switch apparatus 10 and 12 in the housing 14 in a snap-in connection. Each recess further includes a base wall 26 having a central aperture 27 opening to pin terminals on each switch apparatus 10 and 12 and a pair of laterally offset key slots 28 and 29, respectively, for receiving key means on each switch apparatus 10 and 12, as described hereafter, to properly orient each switch apparatus 10 and 12 in the proper recess and in the correct orientation.

As the switch apparatus 10 and 12 include a number of common elements, the following description of the construction and operation of the switch apparatus 10 will be understood to apply equally to the construction of the switch apparatus 12, except for the differences which will be described separately for the switch apparatus 12.

As shown in detail in FIGS. 2A–7 the switch apparatus 10 is formed with a base 30, a printed circuit board assembly 32 including at least one printed circuit board, and, preferably, in the present application, two printed circuit boards 34 and 36, a first switch actuator 40 and a second switch actuator 42. The switch actuator 40 is devised, in the present example, as a pushbutton used to control the on and off state of the vehicle fog lamps. The second switch actuator 42 is constructed, in the present example, to control the driver's heated seat controls via a rotatable thumb wheel 44.

It will be understood, throughout the following description and drawings that the particular functions which each switch apparatus controls will be by example only as the type of switch actuator in each switch apparatus as well as the electrical function or device controlled by each switch apparatus may be revised as necessary to suit a particular vehicle application.

According to a unique aspect of the present invention, the base 30 is identical for all or at least some of the family of switch apparatus employed in a particular vehicle. As shown in FIGS. 2A, 2B, 5 and 6, the base 30 includes a one-piece unitary, molded plastic body 50 having a generally polygonal or rectangular planar wall 52 from which a plurality of vertical flanges 54, 56 and 58 project. The flanges 54, 56 and 58 define a pair of spaced openings which receive the printed circuit boards 34 and 36, respectively. As shown in FIG. 6, a plurality of apertures 60 are formed in the wall 52 in the spaces or openings between the flanges 54, 56 and 58 to define mounting positions for terminals on the printed circuit boards 34 and 36, as described hereafter. A generally hemispherical or arcuate shaped wall 62 projects from the wall 52 and surrounds a high current contact as also described hereafter.

Also formed on the wall 52 are a plurality of walls 64, 66 and 68 which act as light channels or light barrier for illumination devices on the printed circuit boards 34 and 36.

Means are formed on the base 30 for lockingly interconnecting or coupling the base 30 to the housing 38. In a preferred embodiment, a plurality of laterally, outwardly projecting arms 70 are formed on the side edges of the wall 52 and project laterally outward therefrom along two opposing side edges of the wall 52. The arms 70 interact with apertures formed in the housing 38 as described below in conjunction with the description of the structure of the housing 38.

A plurality of stop projections arranged in opposed pairs 72 and 74 are also formed along the side edges of the wall 52 to support the lower edge of the housing 38 when the housing 38 is coupled to the base 30.

Figure 2A:
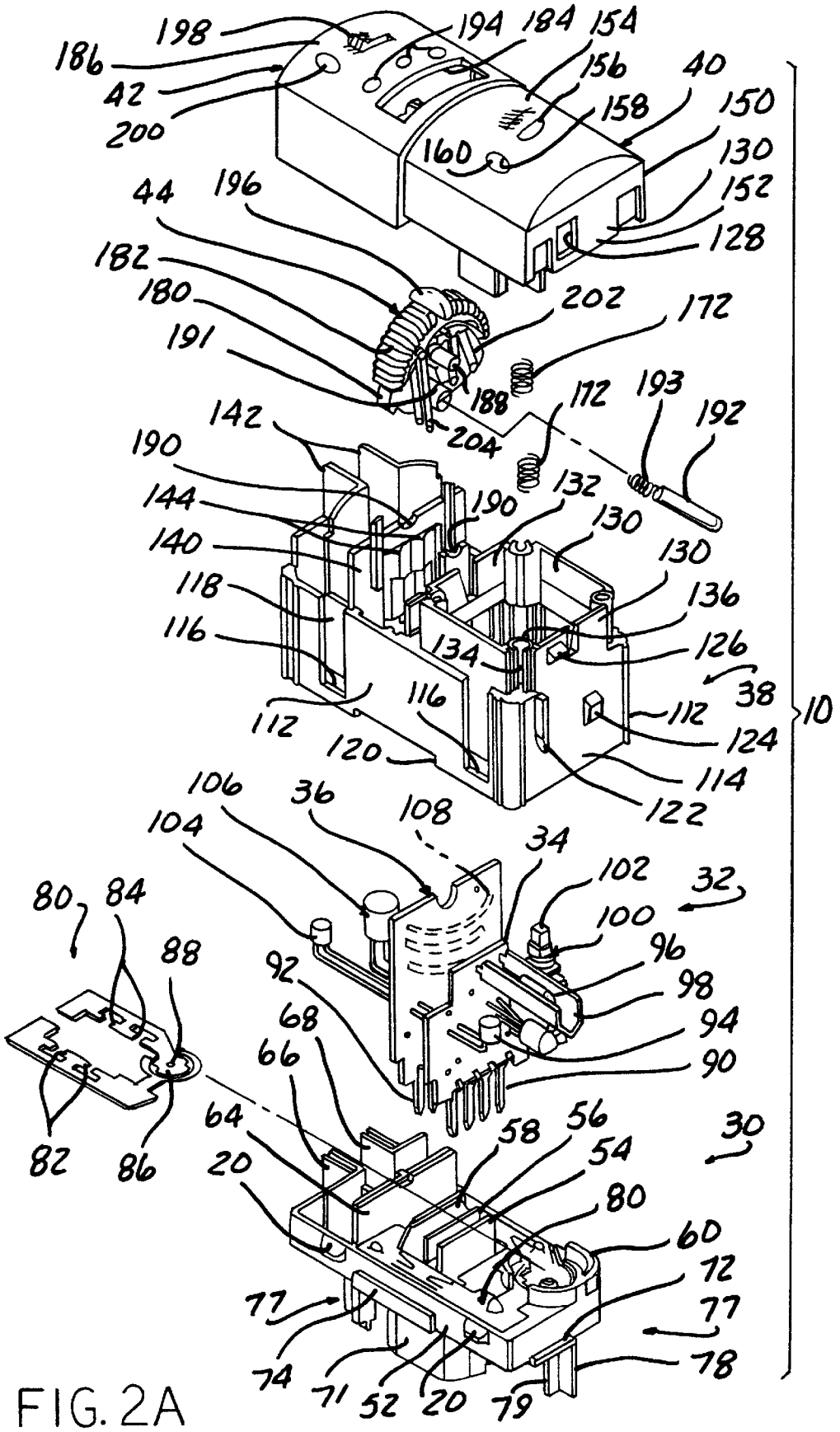
FIG. 2A is an exploded, perspective view of one of the switch apparatus shown in FIG. 1.
Figure 2B:
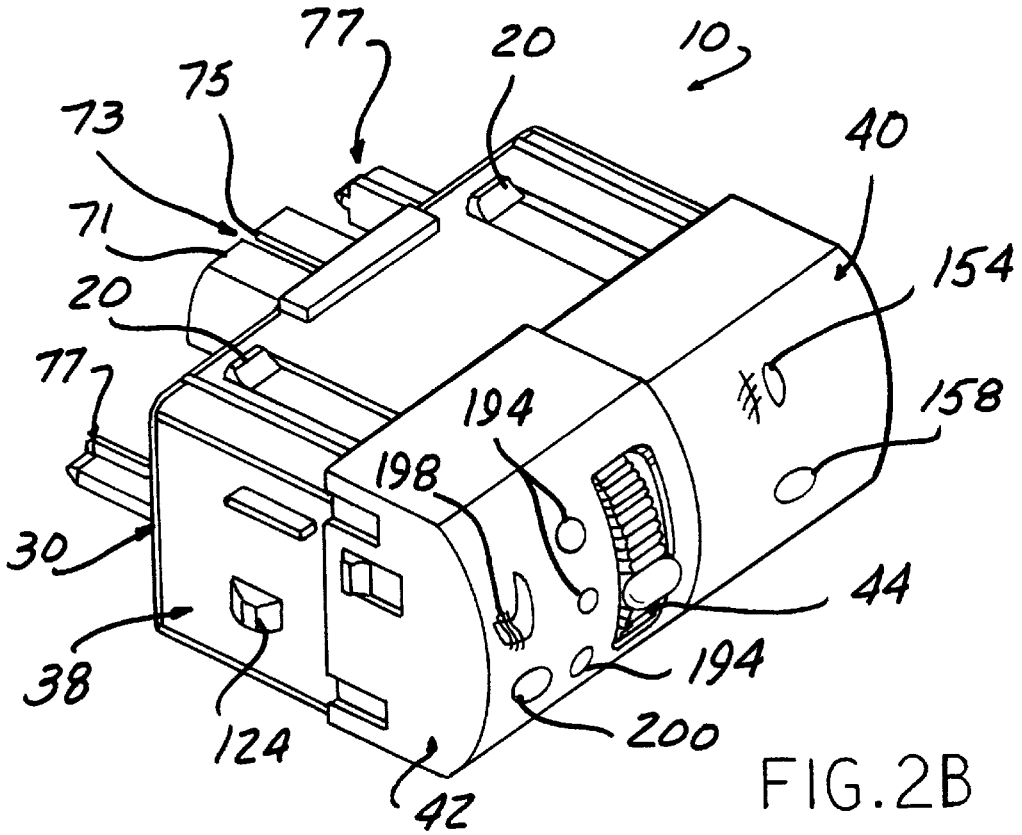
FIG. 2B is an assembled perspective view of the switch apparatus shown in FIG. 2A.

As shown in FIGS. 2A and 2B, and in greater detail in FIGS. 1B and 6, a tubular sleeve projects from the bottom surface of the wall 52 and has an interior cavity surrounding the terminals 90 and 92 from the printed circuit boards 34 and 36. The interior cavity is sized to receive a conventional, pin-type electrical connector, not shown, engagable with the terminals 90 and 92.

According to a unique feature of the present invention, a key means 73 is formed in the barrier 71 to ensure that the proper connector is connectible to only the proper switch apparatus 10 or 12. By way of example only, the key means 73 is in the form of a pair of slots 75 which are spaced apart on various walls of the barrier 71 and mate with projections or ribs formed exteriorly on the mating electrical connector to ensure that only the proper electrical connector can be mounted in the barrier 71, and, also, the connector is properly oriented with respect to the terminals 90 and 92.

Keyed mounting means 76 in the form of two spaced keys 77 also project from the bottom surface of the wall 52. The keys 77, by example only, have a T-shaped formed of a stem 78 and a cross member 79.

As shown in FIG. 6, the two keys 77 are laterally offset from each other on the wall 52. By example only, the leg 79 of each key 78 projects outward toward one side wall of the wall 52. Mating T-shaped apertures are formed in the bottom wall of the instrument panel 14 to receive the keys 78 on the switch apparatus 10 only when the switch apparatus 10 is in the proper position relative to the instrument panel 14 and oriented properly within the mounting portion of the instrument panel 14. The keys 77 are uniquely positioned by sonic or heat welding to the wall 52 of the base 30.

Figure 5:
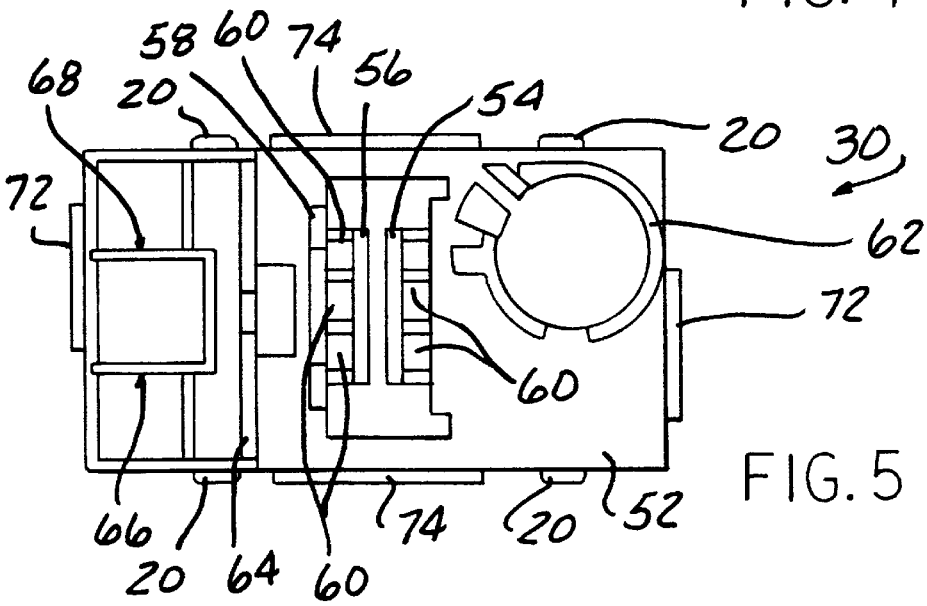
FIG. 5 is a plan elevational view of the base of the switch apparatus shown in FIGS. 2A and 2B.
Figure 6:
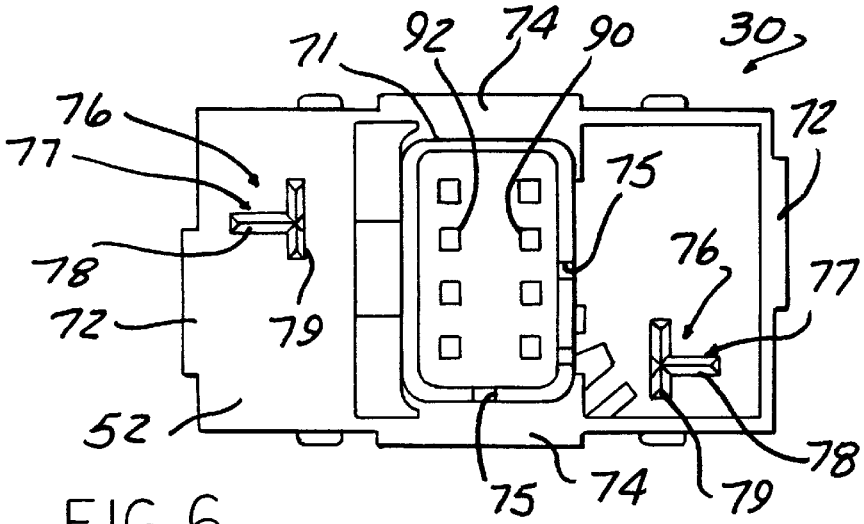
FIG. 6 is a bottom elevational view of the base shown in FIGS. 2A and 5.

As shown in FIGS. 2A and 5, an electrically conductive sheet or foil 80 is mounted on the wall 50 and secured in place by means of heat stakes. The conductive foil 80 includes a pair of leaf contacts 82 and 84 which are integrally formed with the foil 80 and resiliently extend out of the plane of the main portion or surface of the foil 80. The leaf contacts 82 and 84 are positioned, when the foil 80 is mounted on the wall 52 of the base 30, to engage certain terminals on the printed circuit boards 34 and 36. The foil 80 includes a high current, circular contact pad 86 which is disposed within the interior of the arcuate flange 62 on the wall 52. A raised dimple or projection 88 is formed on the contact 86 for engagement with a movable contact in a high current switch application, as described hereafter.

The printed circuit boards 34 and 36 are specifically designed for the particular function of each switch apparatus 10 and 12. As is conventional, conductive traces are formed on the printed circuit boards 34 and 36 which are connected to a plurality of individual terminals 90 and 92, respectively, projecting from one edge of each printed circuit board 34 and 36.

For the particular application of the switch apparatus 10 in controlling vehicle fog lights, the printed circuit board 34 is provided with a first illumination device, such as a lamp or LED 94, to indicate the on or off status of the vehicle fog lamps as controlled by the switch apparatus 10, and a second illumination device, such as a lamp or LED 96 which is illuminated whenever the vehicle is operated and/or the vehicle headlights are on to illuminate the switch location indicia formed on the switch actuator 40. It should be noted that the lamp or LED 96 is disposed within a channel member 98 mounted on the printed circuit board 34 which acts as a light blocking barrier to direct the light emitted by the lamp or LED 96 upward toward the switch actuator 40 without mixing with the light emitted by the other lamp or LED 94.

Also mounted on the printed circuit board 34 is a separate switch 100 including a spring biased plunger 102. The plunger 102 is engaged by an actuator member on the switch actuator 40, as described hereafter, to control the position of an internal switchable contact within the switch 100. The plunger 102 remains in a depressed position after the first engagement with the actuator 40 until engaged a second time in the actuator 40. Output terminals from the contact in the switch 100 are connected via conductive traces on the printed circuit board 34 to selected terminals 90.

The printed circuit board 36 is similarly constructed and includes first and second illuminating devices, such as lamps or LEDs 104 and 106 which respectively provide an indication of the on or off status of the heated seat controlled by the switch apparatus 12 in the case of the lamp or LED 104. The lamp or LED 106 provides illumination to the switch location indicia carried on the surface of the actuator 42 to indicate the location of the switch apparatus 12. A plurality of arcuate shaped, radially spaced conductive traces 108 are formed on the printed circuit board 36 and are connected to selective terminals 92. The arcuate traces 108 are wiped and selectively connected by means of leaf contacts 202 and 204 carried on the thumb wheel 44 as described hereafter.

Figure 3:
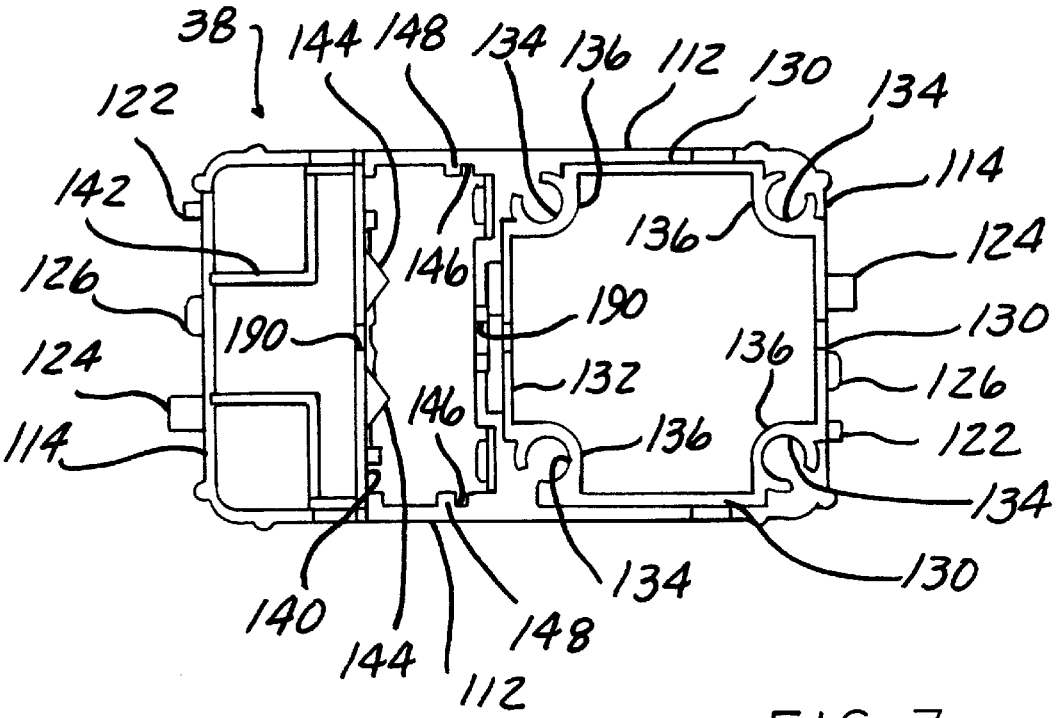
FIG. 3 is a plan elevational view of the housing of the switch apparatus shown in FIGS. 2A and 2B.
Figure 7:
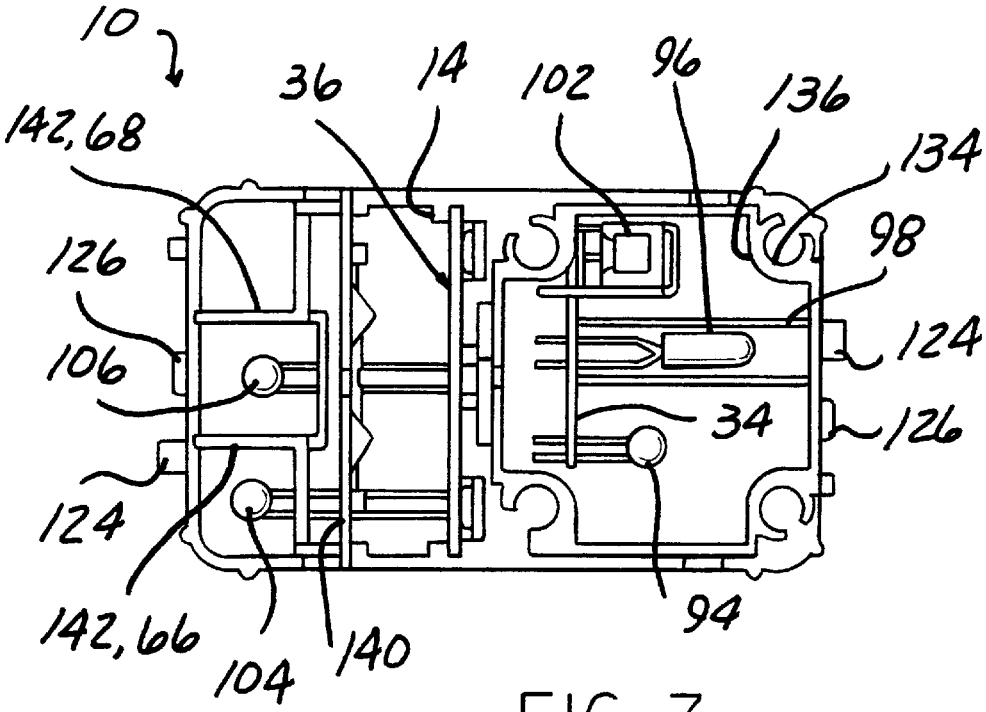
FIG. 7 is a plan elevational view of the assembled base, printed circuit board and housing of the switch apparatus shown in FIGS. 2A and 2B.

Referring now to FIGS. 2A, 3 and 7, the detailed construction of the housing 38 will now be described. The housing 38 includes a one-piece, molded body 110 formed of a suitable plastic material. The body 110 is formed in a polygonal or rectangular shape having two opposed pairs of side walls 112 and 114.

Each side wall 112 is formed with at least one and preferably a pair of apertures 116, each located in a recess 118 formed in the side wall 112. The apertures 116 engage the arms 70 projecting from the wall 52 of the base 30 to couple the housing 38 to the base 30 in a snap together connection. The stop projections 72 on the base 30 engage the lower surface of the side walls 114 of the housing 38 to securely seat the housing 38 on the base 30. Similarly, the stop projections 74 on the base 30 fit into complementary shaped notches 120 formed on the side walls 112 to position and support the housing 38 with respect to the base 30.

Each side wall 114 of the housing body 110 includes an outwardly projecting rib 122 which acts as a limit stop to the lower edge of either switch actuator 40 or 42. Laterally offset latch arms 124 project from each of the side walls 114 and are adapted to snap into complementary shaped apertures formed in the instrument panel housing 14 as shown in FIG. 1.

In the present exemplary configuration of the housing 38 which supports a movable switch actuator 40 and a fixed switch actuator 42 having a rotatable thumb wheel 44, the housing body 110 is provided with another latch arm or projection 126 formed on an upper portion of one of the side walls 114 of the body 110. The latch arm or projection 126 engages and slides within a slot 128 formed on a side edge 130 of the switch actuator body or bezel as described hereafter. The interaction of the latch arm 126 and the slot 128 movably couple the switch actuator 40 to the housing 38; but allow sliding movement of the switch actuator 40 relative to the fixed housing 38.

As shown in FIGS. 2A and 2B, a four-sided enclosure is formed in one portion of the body 110 for receiving the switch actuator 40. The enclosure includes three side wall extensions 130 projecting outward from the side walls 112 and 114 and an interconnecting wall 132 which extends across the side walls 112 and is joined at opposite ends to two adjacent walls 130 to form a generally square support for the switch actuator 40. The wall 132 has a height equal to that of the extensions 130. Open ended slots 134 are formed at each corner of the four interconnected side walls 130 and 132. Each slot 134 is formed in a receiver 136 coupled between spaced ends of two adjacent wall 130 and extensions 132. The purpose of the slots 134 and the receivers 136 will be described hereafter in conjunction with the operation of the switch actuator 40.

The other portion of the body 110 of the housing 38 includes a transverse wall 140 extending across the side walls 112 and spaced generally parallel to the side wall 132. A pair of laterally spaced detents 144 are formed on one surface of the transverse wall 140. The detents 144 in the form of raised projections which are engaged by a spring biased plunger carried on the thumb wheel 44 as described hereafter to define discrete rotated positions of the thumb wheel 44. In addition, a pair of L-shaped wall members 142 also project from the side walls 112 and 114 to define interior light channels for the lamps or LEDs 104 and 106 on the printed circuit board 36.

Finally, as shown in FIG. 3, a pair of spaced, aligned notches 146 are formed in the side walls 112. The notches 146 may be formed directly in the side walls 112 or between inwardly extending ribs 148 integrally formed with each side wall 112. The notches 146 define a support for opposed side edges of the printed circuit board 36 to position the printed circuit board 36 relative to the housing 38.

Figure 4:
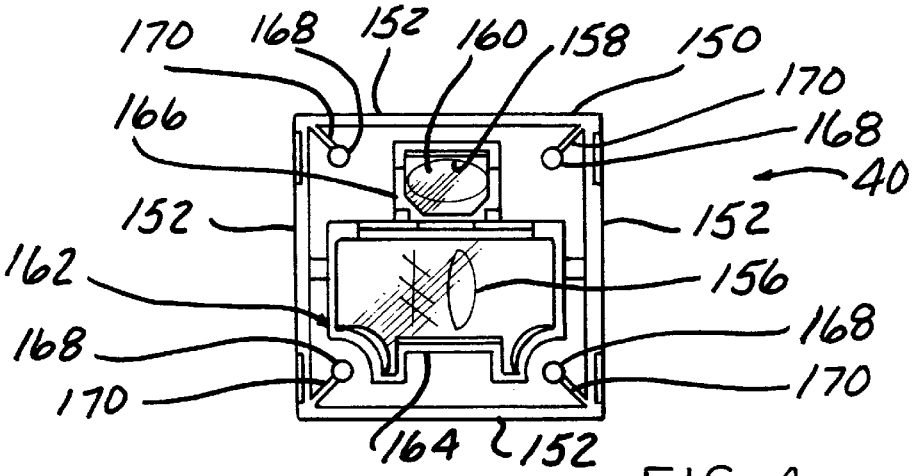
FIG. 4 is a bottom elevational view of one actuator of the switch apparatus shown in FIGS. 2A and 2B.

Referring now to FIGS. 2A, 2B and 4, the switch actuator 40 is shown as a one-piece body 150 having four side edges 152 and a generally arcuate actuator surface or bezel 154. A function indicia or symbol 156, in the present example designating vehicle fog lamps, is formed on the exterior surface of the bezel 154. An aperture 158 is also formed in the bezel 154 for exposing an illuminatable element, such as an interior mounted, transparent or translucent disk 160 which allows light emitted by the lamp or LED 94 to be viewed exteriorly of the switch actuator 40 whenever the vehicle fog lamps have been switched to the on position.

The interior of the body 150 is formed with a generally closed wall 162 which has a portion 164 positioned to engage the plunger 102 on the switch 100 when the body 150 is depressed toward the housing 38. A portion of the wall 162 co-acts with a U-shaped channel 166 extending from the interior surface of the bezel 154 to define a light blocking channel for light emitted by the lamp or LED 94. The disk 160 is located within the U-shaped channel 166 to receive light from the lamp or LED 94.

The indicia 156, although depicted as having a solid form on the bezel 154, is actually formed as a translucent cover on the body 150. In this manner, light emitted by the lamp or LED 96 is directed to and illuminates the indicia 156.

A plurality of circular cross-section posts 168 are formed at the corners of the side edges 152 of the body 150 and are each connected to the side edges 152 by a thin rib 170. Each 170 extends through one open slot 134 in the receivers 136 in the housing 38 to position the post 68 within the circular opening formed within the receiver 136. The posts 168 slide within the receivers 136 to control the sliding movement of the actuator body 150 relative to the housing 38.

As described above, two laterally offset apertures 128 are formed in two opposed side walls 152 of the body 150. The apertures 128 in the side edges 152 engage the latch arm or projection 126 formed on the side wall 114 of the housing 38 and a similar, but laterally offset latch arm 124, not shown, which is formed on the transverse wall 132 between the side wall 132 and the spaced transverse wall 140. The apertures 128 are preferably in the form of elongated slots which allow sliding movement of the actuator body 150 relative to the housing 38 while retaining the actuator body 150 on the housing 38. At least one and preferably a pair of springs 172 seat in the receivers around the posts 168 and against the actuator 40 to bias the actuator 40 to the first position.

As shown in FIGS. 2A and 2B, the thumb wheel 44 of the actuator 42 is in the form of a circular or sector-shaped disk 180 having a user engagable surface 182 formed on at least a portion thereof which projects through an aperture 184 formed in bezel 186 of the switch actuator 42. The user engagable surface 182 may be formed by a series of circumferentially spaced projections.

A pair of outwardly extending pins or axles 188, only one of which is shown in FIG. 2, project from the disk 180 and rotatably engage notches 190 formed in the wall 132 and transverse wall 140 in the housing 38. A hollow receiver 191 is formed on one side of the disk 180 and receives a plunger 192 and spring 193. The plunger 192 rides across the detents 144 formed in the transverse wall 40 to define at least three distinct positions of the thumb wheel 44. Each position is denoted by indicia 194 on the bezel 186 of the switch actuator 42. As the bezel 186 is preferably formed of a thin translucent material at least in the location of the indicia 194, light emitted by the lamp or LED 106 will illuminate each of the indicia 194. The position of the thumb wheel 44 relative to the three distinct indicia 194 in the present example is provided by the position of one enlarged projection 196 on the thumb wheel 44.

A second indicia 198 is also formed on the bezel 186 adjacent to a transparent sheet 200 mounted within the interior of the bezel 186. An L-shaped wall projects from the interior surface of the bezel 186 to form a light barrier to direct light from the lamp or LED 104 to the sheet 200 to illuminate the sheet 200 when the LED 104 is illuminated depicting operation of the electrical device controlled by the switch actuator 12 which, in the present example, is a heater element in the vehicle driver seat having an off position and two distinct power positions, i.e., "low heat" and "high heat".

As the bezel 186 is non-movable relative to the housing 38, the bezel 186 is fixedly mounted on the housing 38 by means of an interlocking arm and aperture formed on one side wall 114 of the housing 38 and one side edge of the bezel 186 and two arms on the wall 140 and two apertures on the opposite side edge of the bezel 186.

As shown in FIG. 2A, a plurality of leaf contacts arranged in two pairs 202 and 204 are fixedly mounted on the disk 180 of the thumb wheel 44. Each leaf contact pair 200 and 202 projects at a different length from a common end or at a different end spacing to engage different conductive traces 108 on the printed circuit board 36 as the thumb wheel 44 and the leaf contacts 202 and 204 rotate across the conductive traces 108 on the printed circuit board 36. This rotational movement of the thumb wheel 44 engages selected leaf contacts 202 and 204 with selected conductive traces 108 to complete an electrical circuit through different terminals 92 on the printed circuit board 36.

The above described construction of the switch apparatus 10 affords several advantages over previously devised switch apparatus. Since a common base is usable on many of a family of like switch apparatus, simplification, ease of assembly and a reduced manufacturing cost can be realized. The housing is also common to many of the switch apparatus affording further cost reductions. In addition, since the base and housing accommodate two individual switch devices, only a single cable and a single connector is needed to connect to the terminals 90 and 92 projecting from the circuit boards 34 and 36 in the switch apparatus 10 and 12. This reduces the number of wiring connections in the body wiring harness or cable and its associated connector as well as reducing the number of wire or cut lead connections in the two switch apparatus 10 and 12 since a common power and a common ground connection may be provided by two wires in the cable and two terminals 90 and 92 rather than two separate power and ground connections for each of the two switch devices in each switch apparatus 10 and 12 as in prior switches.

Figure 9:
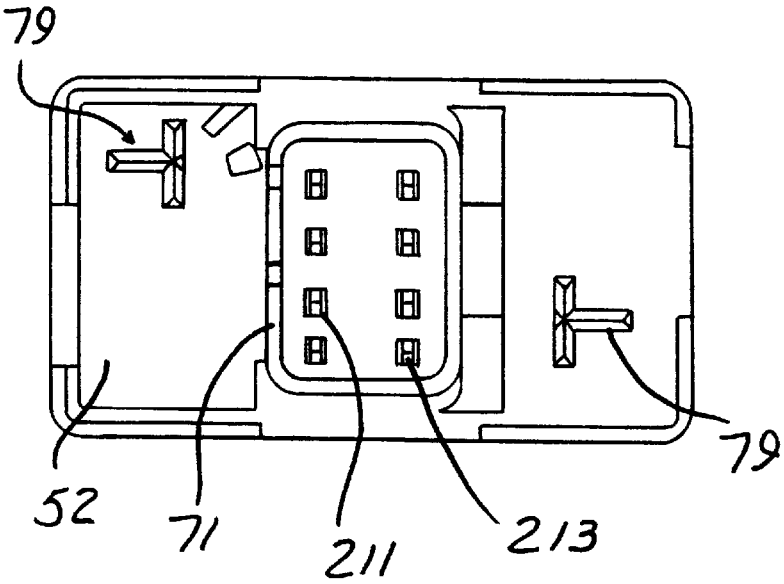
FIG. 9 is a bottom elevational view of the base of the switch apparatus shown in FIG. 8A, depicted in a 180° rotated mounting position from the base in FIG. 6.
Figure 8A:
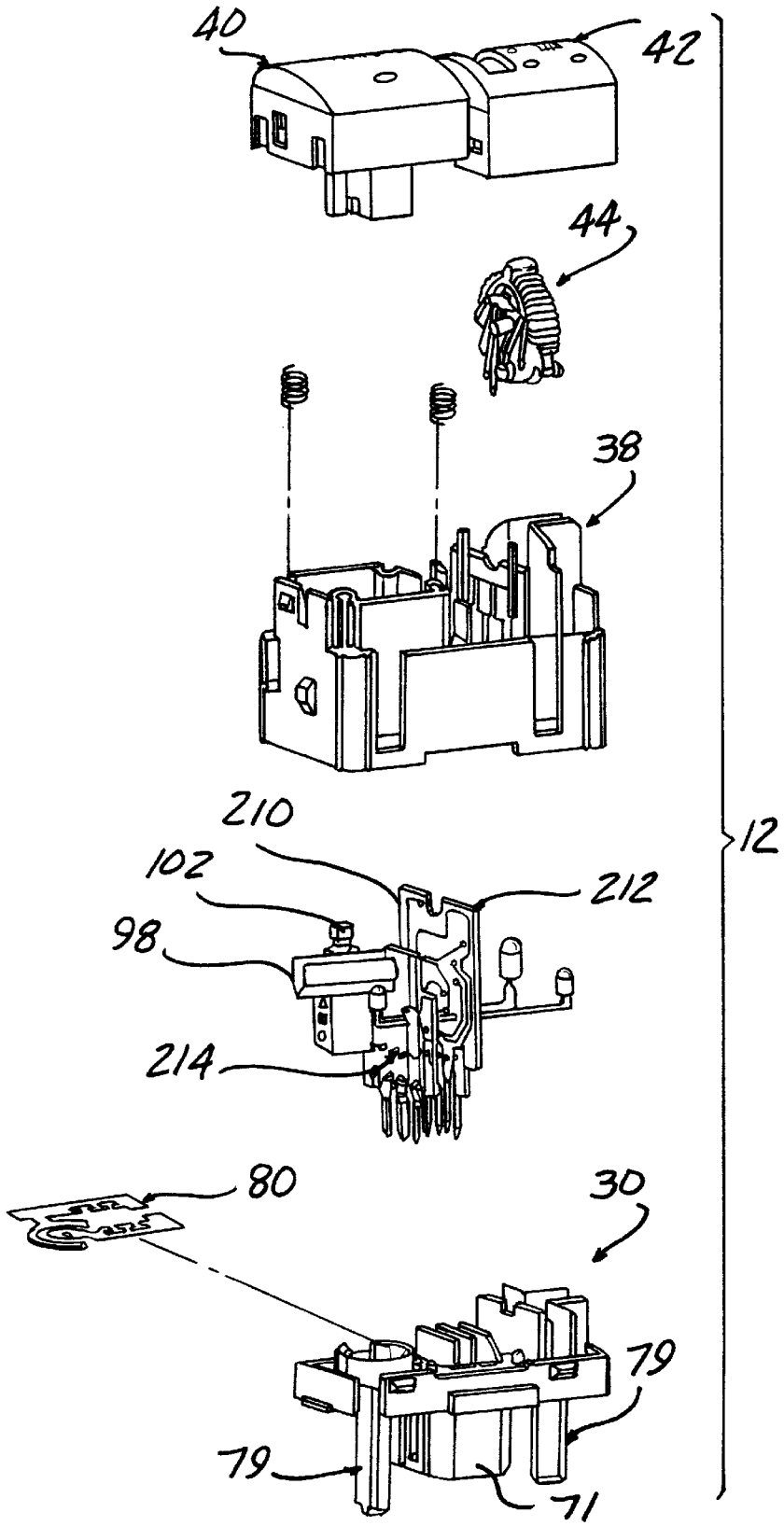
FIG. 8A is an exploded, perspective view of the other switch apparatus shown in FIG. 1.
Figure 8B:
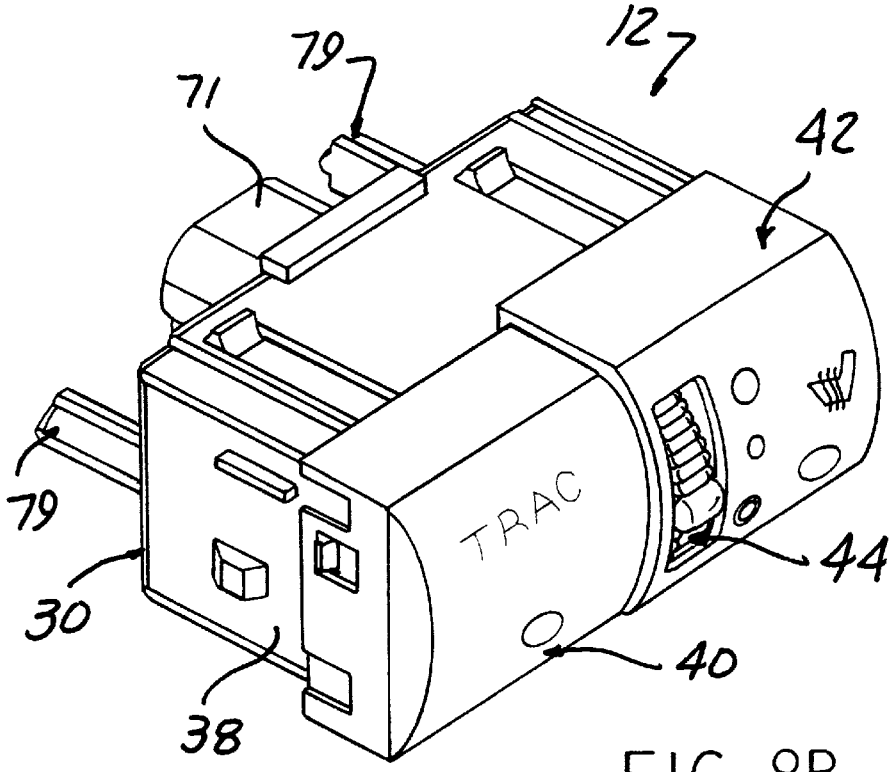
FIG. 8B is an assembled perspective view of the switch apparatus shown in FIG. 8A.
Figure 12:
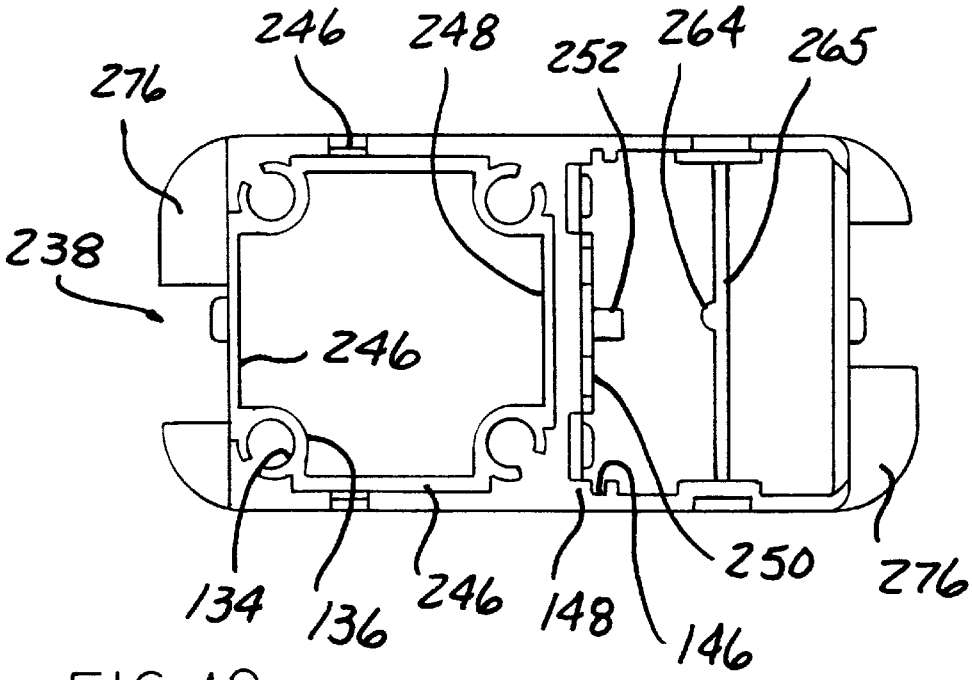
FIG. 12 is a plan elevational view of the housing of the switch apparatus shown in FIG. 10A.

Referring now to FIGS. 8A, 8B and 9, there are depicted components forming the switch apparatus 12.

As partially described above, the switch apparatus 12 is substantially identical to the switch apparatus 10; but is rotated 180° with respect to the orientation of the switch apparatus 10 and mounted side-by-side with the switch apparatus 10 as shown in FIG. 1. Identical components in the two switch 10 and 12 will be depicted by the same reference number. Thus, the switch apparatus 12 includes a base 30, a housing 38, first and second switch actuators 40 and 42. The second switch actuator 42 includes a rotatable thumb wheel 44.

The switch apparatus 12 also includes a printed circuit board assembly 210 formed of first and second printed boards 212 and 214. Further details concerning the construction and operation of the printed circuit boards 212 and 214 will not be provided as the overall function of the printed circuit boards 212 and 214 and the components and conductive traces mounted thereon are substantially the same as the printed boards 34 and 36 described above. The only exception is a different mounting orientation for the switch 100 and the plunger 102 on the printed circuit board 214.

In the present example, the switch actuator 40 and associated printed circuit board 214 and switch 100 are connectible through the terminals 211 and 213 extending from the printed circuit board 214 to an electrical connector coupled thereto to control the traction control circuit and device in the vehicle. Depression of the first actuator 40 activates the traction control. A subsequent depression of the actuator 40 will cause a deactivation of the traction control.

The second switch actuator 42, in this example of the switch apparatus 12, defines a three positioned heated passenger seat control including one "off" position and two heat settings, such as "low heat" and "high heat". This is identical to the construction and operation of the second switch actuator 42 and the switch apparatus 10 described above.

In FIGS. 8A and 9, the base 30 of the switch apparatus 12 has been rotated 180° for mounting in the instrument panel 14. The keys 79 on the base 30 of the switch apparatus 12 are mounted on the wall 52 in a different lateral position and in a different orientation from the keys 77 on the base 30 of the switch apparatus 10. The instrument panel 14 has complementary shaped mounting key slots for receiving the keys 77 and 79 on the base 30 of the switch apparatus 12 and 14; but only when each switch apparatus 12 and 14 is aligned within the proper mounting position in the instrument panel 14 and oriented as shown in FIG. 6. In this manner, the switch apparatus 10 and 12 are each mountable in only one discrete position within the instrument panel 14.

It will also be understood that the base 30 employed in each of the switch apparatus 10 and 12, while described as being identical for each switch apparatus 10 and 12, is provided with unique keyed mounting means 76 as well as unique key means 73 on the barrier wall 71.

Figure 10B:
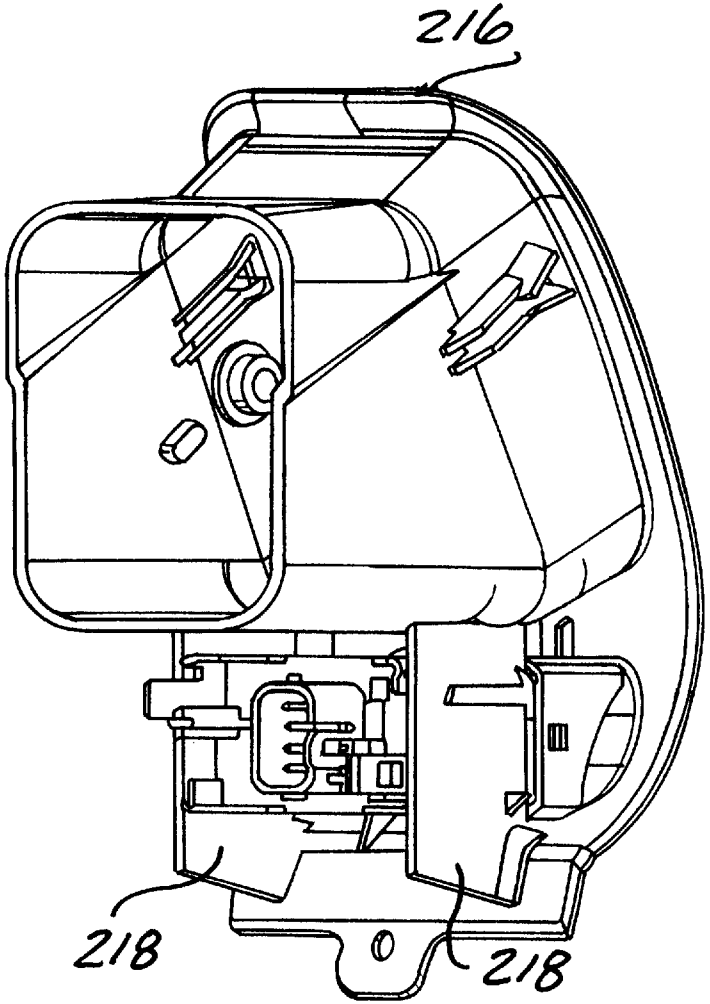
FIG. 10B is a bottom side perspective view of the switch apparatus and support shown in FIG. 10A.
Figure 10A:
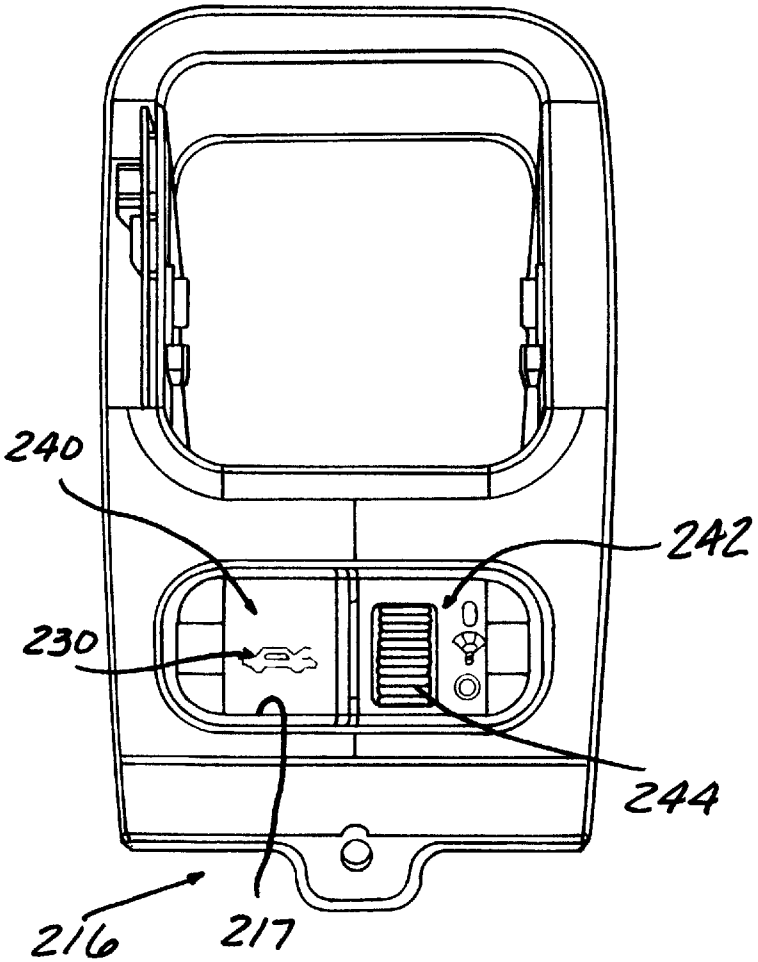
FIG. 10A is a front elevational view of a switch apparatus according to another aspect of the present invention mounted in a different instrument panel support.
Figure 11:
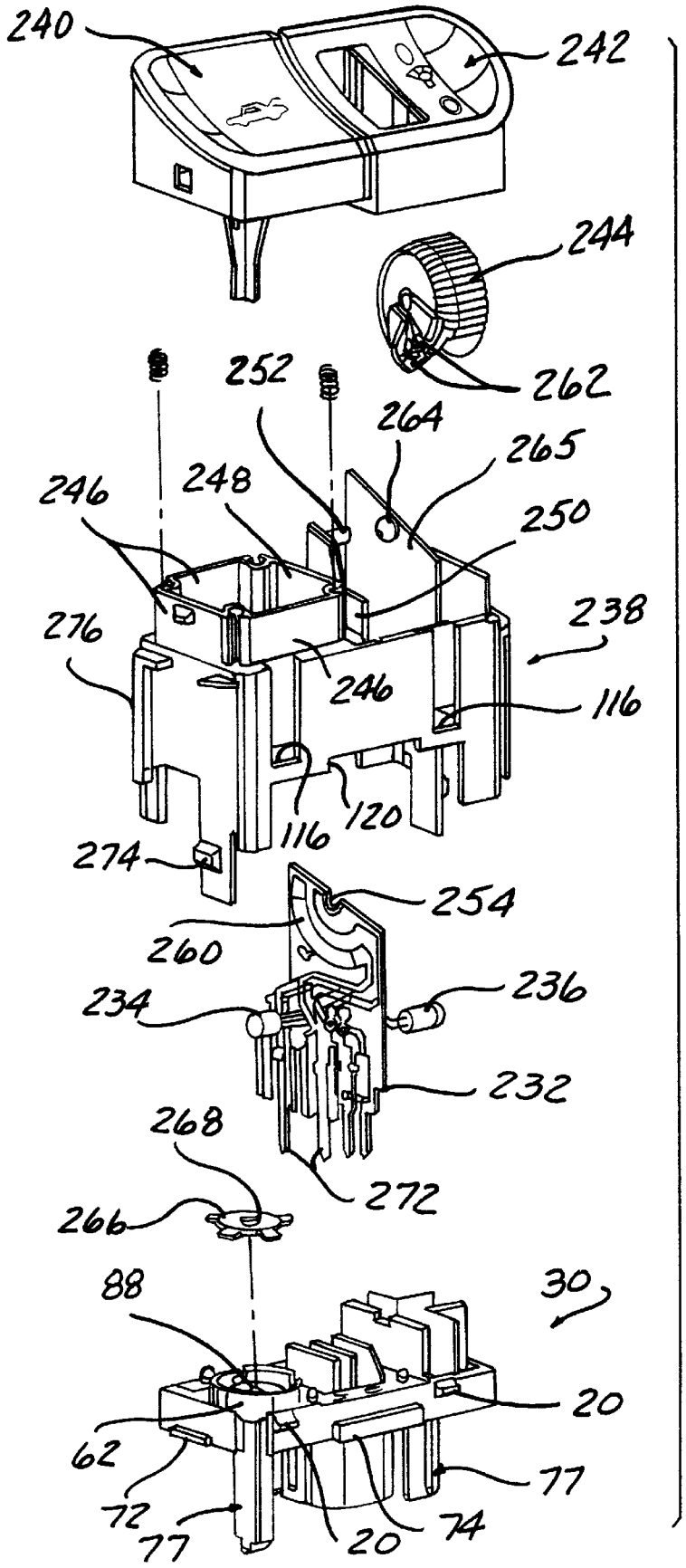
FIG. 11 is an exploded, perspective view of the switch apparatus shown in FIGS. 10A and 10B.

FIGS. 10A and 10B depict an alternate switch support housing 216 which may be mounted in a different location on the vehicle instrument panel or at any other location within the interior of the vehicle from the housing 14 shown in FIG. 1A. The housing 216 includes two apertures, one designed for receiving a vent, or other device and a second aperture for receiving a switch apparatus 230 according to another aspect of the present invention. As shown in FIG. 10B, a pair of depending walls 218 depend from opposite side edges of the recess 217 in the housing 216 for receiving mating latch members on the switch apparatus 230 as described hereafter.

FIGS. 10A, 10B, 11 and 12 depict an alternative embodiment of a switch apparatus 230 according to the present invention. The switch apparatus 230 utilizes the same base 30 as in the switch apparatus 10 and 12 described above. As shown in FIG. 10, the switch apparatus 230 also includes a printed circuit board assembly 232 in the form of a single circuit board having a pair of illuminatable devices, such as lamps or LEDs 234 and 236 connected thereto and projecting outward from opposed surfaces of the printed circuit board 232. The switch apparatus 230 also includes a housing 238 and first and second switch actuators 240 and 242 with a thumb wheel 244 rotatably mounted in the second switch actuator 242.

The housing 238 is connectible to the base 30 by means of arms 70 projecting from the base 30 which engage apertures 116 in opposed side walls of the housing 238. Stop projections 72 and 74 on the side walls of the base 30 likewise engage lower edges and a notch 120 in the side walls of the housing 238 to support the housing 238 on the base 30.

The housing 238 includes a four-sided upper extension formed of three contiguously joined side walls 246 and a transverse wall 248. A parallel wall 250 is disposed adjacent to the transverse wall 248 and forms a light barrier to direct light from the lamp or LED 236 to the indicia on the second switch actuator 242. The other lamp or LED 234 on the printed circuit board 232 is disposed underneath the joined side walls 246 and transverse wall 248 such light emitted by the LED 234 is directed to the first switch actuator 240. A projection 252 extends from an upper end of the wall 250 and seats within a notch 254 formed in the upper end of the printed circuit 232 to fixedly mount the circuit board 232 within the housing 238.

Conductive traces 260 on the printed circuit board 232 are selectively connected by a pair of leaf contacts 262 carried by the rotatable thumb wheel 244. The projection 252 also engages a bore formed in the thumb wheel 244 to rotatably support the thumb wheel 244. An aligned projection 264 formed on an end wall 265 engages the opposite end of the bore in the thumb wheel 244.

The leaf contacts 262 and one conductive trace 260 form a potentiometer which enables variable adjustment of the intensity of the instrument panel lights, in the present application example, as the thumb wheel 244 is rotated from an "off" position to a full "on" position.

A unique aspect of the switch apparatus 230 involves the use of the high current contact 86 on the foil 80 mounted on the base 30. A dome-shaped contact 266 is movably disposed over the high current contact pad 86 on the foil 80 mounted on the base 30. A projection 268 extends from a planar portion of the dome contact 266 and overlays the dimple or outwardly extending projecting 88 on the high current contact 86.

Depending legs on the dome contact 266 resiliently spaces the projection 268 from the projection 88. A foam disk, not shown, overlays the dome contact 266 to prevent rattling of the dome contact 266.

The first switch actuator 240 includes a depending actuator arm 270 having a lower end which is aligned with, but is nominally spaced from the projection 268 on the dome contact 266 when the switch actuator 240 is in the circuit deactivating or "off" position. In the present example, the first switch actuator 240 is designed to activate the vehicle deck lid release mechanism which requires high amperage. Depression of the first switch actuator 240 causes the end of the actuator arm 270 to forcibly engage the projection 268 on the dome contact 266 with the dimple 88 on the high current contact 86. This completes a circuit between the high current dome contact 266, the high current contact 88 and a portion of the foil 80 on the base 30 through output terminals 272 which are fixedly mounted in the base 30.

The switch apparatus 230 is mountable in suitable mounts in the instrument panel 14 or other support shown in FIG. 10, for example, by means of the keys 77 on the base 30 as well as latch arms 274 formed on extensions of two opposed side walls of the housing 238 which snap below the walls 218. Locating or guide flanges 276 are also formed on opposed side walls of the housing 238 to locate the housing 238 as well as the remainder of the interconnected switch apparatus 230 to the corresponding mounts in the instrument panel 14.

In summary, there has been disclosed a unique modular, multi-purpose switch apparatus in which two individually operable switches and associated switch actuators are mounted in a single housing which is coupled to a single base mountable to a support, such as vehicle instrument panel housing. In one aspect of the invention, the housing and base are identical for each of a family of like switch apparatus. The inventive switch apparatus reduces the number of leads and wire connections as well as reducing the number of separate parts employed in like switch apparatus thereby reducing the manufacturing cost of the switch and simplifying its assembly. The inventive switch apparatus is also keyed so as to be mountable only in a specific location in the support as well as receiving only a specific harness connector again to simplify mounting in a vehicle and avoid mounting and wiring connection errors.

What is claimed is:

1. A plurality of switch apparatus mountable in groups in a vehicle support, the switch apparatus comprising:

a plurality of identical housings;

at least two independently operable switch actuators mounted in each of the plurality of identical housings, each switch actuator having at least two operable positions;

a plurality of identical bases, one base coupled to each of the plurality of housings;

at least one printed circuit board mounted in the base and having connector terminals extending externally through the base, the printed circuit board carrying conductive traces electrically connected to the connector terminals; and means, engagable with the printed circuit board and interacting with at least one switch actuator, for providing signals to the connector terminals in response to movement of the at least one switch actuator between the two operable positions.

2. The switch apparatus of claim 1 further comprising:

at least one projection formed on one of the housing and the switch actuator; and an elongated aperture formed in the other of each switch actuator and the housing and slidably receiving one projection.

3. The switch apparatus of claim 1 wherein the means for providing signals comprises:

a switch carried on the at least one printed circuit board, the switch having a movable plunger closing a contact to generate an output signal to the conductive traces when the plunger is engaged by movement of the actuator between the first and second positions.

4. The switch apparatus of claim 1 further comprising:

means for keying each one base to the vehicle support in only one mounting orientation.

5. The switch apparatus of claim 4 wherein the keying means is unique for the base.

6. The switch apparatus of claim 4 wherein the keying means comprises:

a pair of key members extending from the base and adapted to be insertable into complementary shaped receivers in a support; and each pair of legs having a first flange and a second flange extending angularly from the first flange.

7. The switch apparatus of claim 1 further comprising:

opposed notches formed in the housing for slidably receiving the at least one printed circuit board.

8. The switch apparatus of claim 1 wherein one switch actuator is a rotary wheel having at least one leaf contact projecting therefrom and engaging the conductive traces on the at least one printed circuit board as the rotary wheel is rotated.

9. The switch apparatus of claim 1 further comprising:

an illuminatable element carried on at least one of the switch actuators; and an illuminatable member carried on the printed circuit board disposed in light communication with the illuminatable element to illuminate the illuminatable element when the illuminatable member is energized.

10. The switch apparatus of claim 9 further comprising one illuminatable element and one illuminatable member for each of the at least two switch actuators.

11. The switch apparatus of claim 1 further comprising:

guide members formed on the housing adapted for guiding the insertion of the housing into a support.

12. The switch apparatus of claim 1 wherein:

the housing is formed with first and second sections; and the at least one printed circuit board comprises two printed circuit boards, one circuit board disposed in each of the first and second sections of the housing.

13. The switch apparatus of claim 1 further comprising:

a conductive member carried on the base, the at least one printed circuit board including contacts engagable with the conductive member when the printed circuit board is mounted in the base.

14. The switch apparatus of claim 13 further comprising:

a high current contact pad formed on the conductive member;

a movable contact movably disposed with respect to the high current contact pad on the conductive member; and one of the switch actuators engaging the movable contact and the high current contact pad when the switch actuator moves from a first position to a second position to provide a high current output through the conductive member and a connector terminal on the at least one printed circuit board.

15. The switch apparatus of claim 1 wherein the at least two switch actuators comprise:

at least four switch actuators arranged in groups of two switch actuators each mountable on one housing and one base.

* * * * *